United States Patent [19]

Griffin et al.

[11] Patent Number: 4,894,208

[45] Date of Patent: Jan. 16, 1990

[54] SYSTEM FOR SEPARATING RADIOACTIVE NA FROM AL

[75] Inventors: Henry C. Griffin, Ann Arbor; Thomas D. Steiger, Saline, both of Mich.

[73] Assignee: The University of Michigan, Ann Arbor, Mich.

[21] Appl. No.: 219,092

[22] Filed: Jul. 14, 1988

[51] Int. Cl.[4] ..... C22B 26/10

[52] U.S. Cl. ..... 423/2; 423/180; 423/200; 252/630; 252/631; 252/632; 376/192; 376/195

[58] Field of Search ..... 423/2, 180, 200; 252/625, 630, 631, 632, 644; 376/192, 195

[56] References Cited

PUBLICATIONS

The Determination of Sodium in Aluminium and its Alloys by Vacuum Distillation by McCamley, Scott and Smart, Analyst, vol. 76, p. 200 (04/51).

*Primary Examiner*—Brooks H. Hunt
*Assistant Examiner*—Virginia B. Caress
*Attorney, Agent, or Firm*—Rohm & Monsanto

[57] ABSTRACT

A system for extracting sodium, particularly radioactive $^{22}Na$, from aluminum utilizes a monel exhaust system for exhausting sodium vapor emitted from a molten aluminum target, in a draft of helium gas. The aluminum target is heated until it is melted in a graphite support cup. The graphite support does not react with the sodium. Moreover, the graphite is understood to be permeable to the helium gas, its porosity being believed to provide the significant advantage that the graphite holder will not absorb much of the sodium vapor. The use of graphite avoids a disadvantageous monel-aluminum reaction whereby an alloy from which sodium cannot be distilled is formed. The resulting sodium vapor is precipitated in a monel exhaust tube which is subjected to temperature control. Sodium can be rinsed from the monel exhaust tube with water.

5 Claims, 1 Drawing Sheet

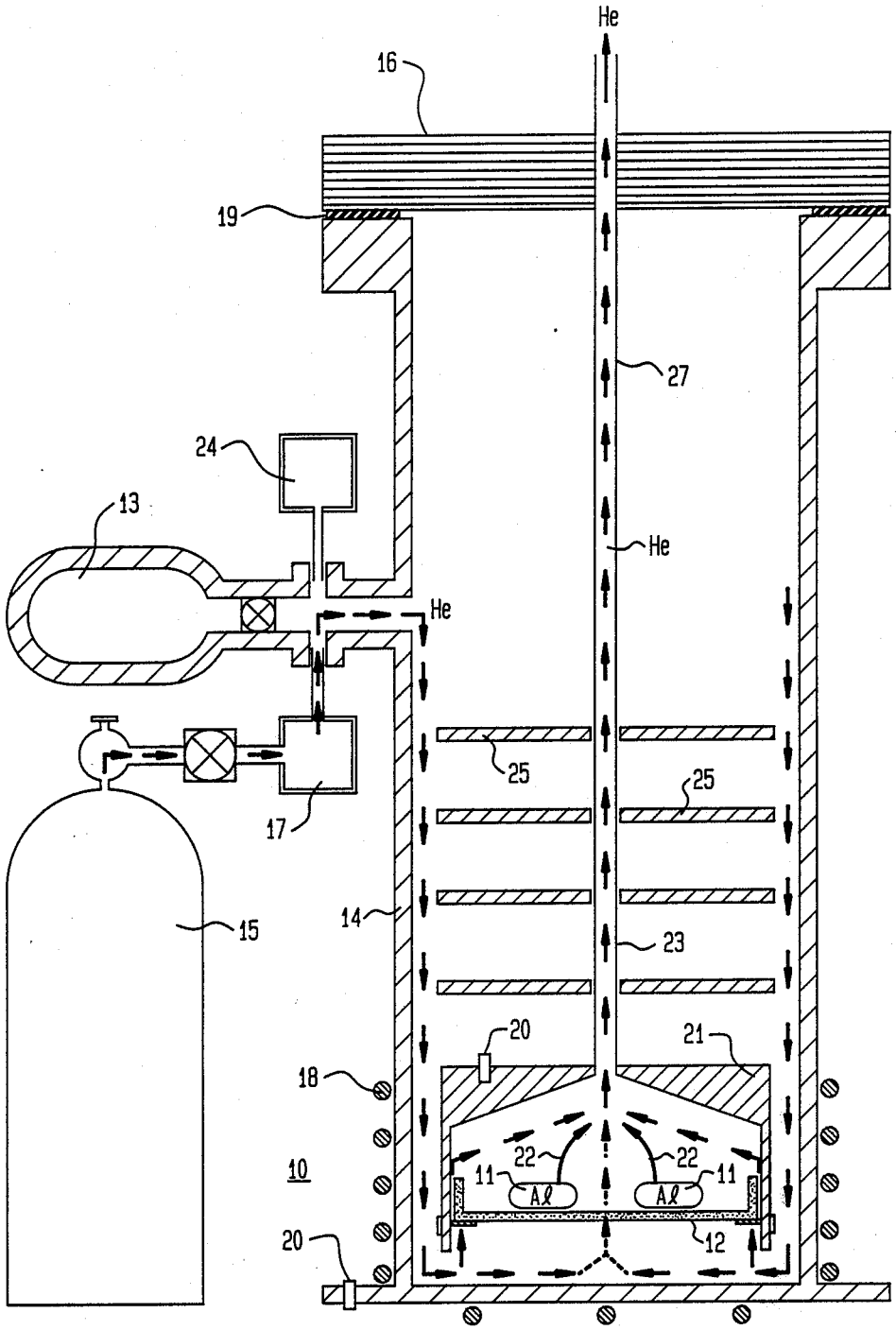
He
16
19
27
24
13
He
He
25
25
17
15
14
23
20
21
18
22
22
10
11
11
Aℓ
Aℓ
12
20

SYSTEM FOR SEPARATING RADIOACTIVE NA FROM AL

BACKGROUND OF THE INVENTION

This invention relates generally to the production of positron sources, and more particularly, to a method and apparatus for separating radioactive Na from Al and collecting the Na, particularly for use in intense slow positron beams.

The study of positrons and their interaction with matter has yielded several actual and potential applications for slow positron beams. However, some of the applications currently under consideration require intense positron beams for their success. The production and study of anti-hydrogen, positron synchrotron light sources, and positron microscopy are a few examples of such fields of study where intense slow positron beams would be quite useful.

The radioactive isotope $^{22}Na$ is an important source of positrons. The current methods for isolating this material involve adding rather large amounts of reagents to target material in order to bring target, product, and impurities into solution. Then the solution is treated to obtain the product, which is often contaminated by sodium from the reagents. Relatively large volumes of waste are produced. Some of the reagents are sensitive to decomposition under intense radiation.

As indicated, one of the most attractive sources for laboratory use is $^{22}Na$, which combines a relatively long (2.6 yr.) half-life with high (90%) positron emittance. Currently, the primary technique for producing large amounts of $^{22}Na$ involves bombarding pure Al with high energy (800 MeV) protons. There is a need for a process or system by which $^{22}Na$ can be simply and inexpensively separated from Al.

The production of a Na source involves a four step process: (1) separation of Na from Al; (2) collection of the separated Na; (3) purification of the collected Na; (4) deposition and sealing of the source. The purification step (step 3) involves a well known technology—ion exchange chromatography—and therefore does not present any significant problems in the overall process. In addition, a process for accomplishing the deposition and sealing of the source (step 4) is readily available. There is a need, however, for a process which accomplishes the step of collecting the Na (step 2).

It is, therefore, an object of this invention to provide a radioactive system useful for producing a $^{22}Na$ source.

It is another object of this invention to provide an improved source of positrons.

It is also an object of this invention to provide a system for producing a component of a system which can be applied to the production of an intense beam of slow positrons.

It is additionally an object of this invention to provide a system for separating Na from Al where high levels of radiation are involved.

It is yet a further object of this invention to provide a system for separating radioactive Na from Al without introducing significant amounts of inactive Na.

It is also another object of this invention to provide a system for separating radioactive Na from Al which does not require the use of additional reagents.

It is yet an additional object of this invention to provide a system for separating radioactive Na from A1 which does not result in significant waste.

It is still another object of this invention to provide a system for separating radioactive Na from Al which is relatively insensitive to radiation.

SUMMARY OF THE INVENTION

The foregoing and other objects are achieved by this invention which provides, in a first aspect thereof, a method of separating sodium from aluminum. In accordance with the invention, the method employs as a first step thereof the heating of the aluminum to a melting temperature whereby the sodium therein is released as a vapor. The melted aluminum is subjected to a draft of an inert gas, the gas being vented into an exhaust tube, for transporting the sodium vapor into the exhaust tube. The exhaust tube is then subjected to a thermal gradient, whereby as the inert gas passes through a cooled region of the exhaust tube, the sodium in the inert gas is plated to the interior of the exhaust tube.

In one embodiment of the invention, the method includes the further step of rinsing the exhaust tube with water to recover the sodium plated therein. Subsequently, the sodium is extracted from the rinse water. Preferably, the exhaust tube is formed of monel, because sodium does not adhere well to this material, and therefore removal of the sodium therefrom is facilitated.

The step of heating the aluminum is performed while the aluminum is in a graphite holder. As indicated hereinabove, graphite provides significant advantages and is porous to the inert gas, which, in a specific illustrative embodiment of the invention, is helium.

In accordance with an apparatus aspect of the invention for extracting radioactive sodium from aluminum, the apparatus is provided with a support for supporting the aluminum, a heater for heating the supported aluminum to a melting temperature, whereby a sodium vapor is emitted from the aluminum, a vent for drawing away the sodium vapor emitted by the aluminum, and a thermal gradient system for producing a thermal gradient in the vent whereby the sodium vapor is caused to plate onto the vent. Preferably, the vent, in the form of a vent tube, is formed of monel.

In one highly advantageous embodiment of the invention, there is further provided a gas inlet for receiving an input inert gas which combines with the sodium vapor and transports the vapor to an inlet of the vent system. In this embodiment, the input inert gas is helium.

The thermal gradient system is formed of a plurality of baffle members for impeding propagation of the heat produced by the heater, through the vent. In certain embodiments, the vent is provided with a shroud arranged in the vicinity of the support. The shroud also is formed of monel and is coupled to the vent tube so as to ensure collection of the sodium vapor. Additionally, the support for the aluminum is formed of graphite, for the reasons set forth above.

In accordance with a further apparatus aspect of the invention for extracting radioactive sodium from aluminum, the apparatus is provided with a graphite support for supporting the aluminum, a heater for heating the aluminum to a melting temperature whereby a sodium vapor is emitted therefrom, a helium gas draft system for forming a helium gas draft which combines with the sodium vapor emitted by the melted aluminum, a monel exhaust system for exhausting the helium gas draft with the sodium vapor combined therewith; and a temperature control system for controlling the temperature of the monel exhaust system to a temperature where the sodium vapor precipitates thereon.

In this specific illustrative embodiment of the invention, the monel exhaust includes a monel shroud for collecting the helium gas draft with the sodium vapor combined therewith, and a monel exhaust tube for cooling the helium gas draft with the sodium vapor combined therewith, whereby the sodium vapor precipitates onto the interior of the monel exhaust tube.

This apparatus aspect of the invention is further provided with a chamber for containing the graphite support and the monel exhaust system. Additionally, the chamber contains therewithin the temperature control system for cooling the exhaust tube. Preferably, the chamber is formed of a body formed of monel for forming a continuous wall, and a seal arrangement disposed at the end of the monel body for sealing the chamber. The chamber is further provided with a gas inlet for introducing the helium gas draft into the chamber.

BRIEF DESCRIPTION OF THE DRAWING

Comprehension of the invention is facilitated by reading the following detailed description, in conjunction with the annexed single drawing which is a schematic representation of an apparatus for separating $^{22}$Na from Al and collecting the $^{22}$Na.

DETAILED DESCRIPTION

At 660° C., which is the melting temperature of Al, the vapor pressure of Na, which has a concentration appropriate for making intense positron sources, is 60 torr while that of Al is $<10^{-5}$ torr. Thus, Na can be quickly and easily distilled (separated) from an Al target simply by melting the Al. In fact, 97% of the Na can be removed in this manner. In one specific embodiment of the invention, the Al remains molten for separation for a period of approximately 40 minutes. However, the duration of the molten state of the Al may be varied over a relatively wide range.

Separation efficiency is not greatly affected by the amounts of Na which are extracted, including large amounts as are necessary for intense positron sources.

With respect to the collection process, the present invention provides a very efficient separation process but the collection of the Na is complicated by the fact that the Na is removed as a free vapor. The figure is a schematic representation of a collection/separation apparatus 10 which is constructed in accordance with the principles of the invention. Initially, the Na (not specifically shown) resides in Al chunk 11 which rests in a graphite cup 12. The system is pumped down by a pump 13 to $<100$ microns and flushed with He obtained from a helium bottle 15. This process is repeated several times to minimize the amount of oxygen present.

Collection/separation apparatus 10 is contained substantially within a body 14 which is made of monel, illustratively monel tubing. The top of body 14 is sealed by a sealing cap 16 with a gasket 19, which may be made of viton material, interposed between the sealing cap and the monel body 14.

A flow of approximately 800 ml/min of He is started and maintained throughout the process. The flow of He is monitored via a flow meter 17. Moreover, pressure in the system is monitored by a pressure meter 24. Heating of the system is achieved by a plurality of heaters 18, and the temperature is monitored by chromel/alumel thermocouples 20 at two locations: outside the system near the heaters and on a monel cone 21.

As previously indicated, the Al typically remains molten for some 30–40 minutes. Upon leaving Al chunk 11, the Na vapor, which is designated by arrows 22, is directed into a monel collection tube 23, by the flow of He. The figure further shows a plurality of heat baffles 25 which ensure that a top portion 27 of monel collection tube 23 remains cool. The Na plates out on the cool interior surface of monel collection tube 23, and can be rinsed off with water.

As indicated, after leaving the molten Al, the Na vapor is directed into the collection tube by the flow of He gas. However, heat baffles 25 maintain a strong thermal gradient up the collection tube so that the top portion 27 of the tube remains essentially at room temperature. This collection geometry is advantageous because the monel collection tube 23 provides a large surface area for collection which can be washed with a small volume of liquid. This minimizes the amount of contamination introduced by the process and simplifies the subsequent purification process.

The entire apparatus is constructed of monel (70% Ni, 30% Cu). Na does not adhere well to monel even at elevated temperatures. This advantageous characteristic of monel facilitates the rinsing of the collected $^{22}$Na and simplifies decontamination of the apparatus in the event of a mishap.

The graphite cup is necessary because molten Al forms an alloy with monel and the Na does not distill from the alloy. Graphite was chosen because, even though it is porous and permeable to Na vapor, it does not react with Na. In fact, the porosity of the graphite is advantageous. Graphite cups of different configurations and materials were tested and it has been learned that cups made of low grade graphite absorbed approximately 20% of the separated Na, while cups made of less porous nuclear grade graphite absorbed approximately 60%. The increased porosity of the low grade graphite, it is believed, allows the He to flow through the cup itself preventing much Na from remaining in the cup.

A key variable for the collection process is the rate of flow of the He gas. It has been learned that nothing more is gained by increasing the flow rate (see table) above a certain point, and if the He flow rate is too high, convective cooling prevents the Al from melting.

TABLE

EFFECT OF FLOW RATE ON COLLECTION
(percentages are of separated Na)

| FLOW RATE (ml/min) | LOST OUT BOTTOM | IN COLLECTION TUBE |
|---|---|---|
| 330 | 57% | 7% |
| 810 | approx. 3% | approx. 69% |
| 1080 | approx. 3% | approx. 69% |

The total efficiency (separation efficiency X collection efficiency) for getting Na into the collection tube is approximately 60% at present. Even if there is not much improvement in this number, the overall efficiency of the process can still be improved. Na which fails to vacate the Al (approximately 5–10%) tends to be trapped in a thin layer at the surface. This Na can be easily recovered by etching the Al and putting the oxide layer into solution. In addition, Na which remains in the graphite cup (approximately 20–30%) might be recovered by subsequent baking of the cup. The present process is very promising for the separation and collection of large quantities (multiple curies) of $^{22}$ for use in intense positron sources. Nearly complete recovery seams feasible. In addition, as compared to presently available systems, the system of the present invention has significant advantages in that it is simpler (therefore more reliable), involves no additional reagents (the target serves as the reagent), and is insensitive to high levels of radiation. The sodium can be distilled from aluminum with the aluminum serving to keep the sodium in the form of volatile, neutral atoms.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A method of separating and collecting radioactive sodium from aluminum, the method comprising the steps of:

heating the aluminum to a melting temperature for releasing the sodium therein as a vapor;

first subjecting the radioactive sodium separated from the aluminum to a draft of an inert gas;

transporting the radioactive sodium in the inert gas into an exhaust tube; and second subjecting the exhaust tube to a thermal gradient whereby as the inert gas passes through a cooled region of the exhaust tube the radioactive sodium therein is plated to the interior of the exhaust tube.

2. The method of claim 1 where there is provided the further step of rinsing the exhaust tube with water to recover the radioactive sodium plated therein.

3. The method of claim 2 where there is provided the further step of extracting the radioactive sodium from the rinse water.

4. The method of claim 1 wherein the exhaust tube is formed of monel.

5. The method of claim 1 wherein the inert gas is helium.

* * * * *